United States Patent [19]

Lisec

[11] Patent Number: 4,836,005

[45] Date of Patent: Jun. 6, 1989

[54] APPARATUS FOR THE PRODUCTION OF SPACER FRAMES

[76] Inventor: Peter Lisec, Bahnhofstrasse 34, A-3363 Amstetten-Hausmening, Austria

[21] Appl. No.: 180,827

[22] Filed: Apr. 12, 1988

[30] Foreign Application Priority Data

May 11, 1987 [AT] Austria ..... 1182/87

[51] Int. Cl.[4] ..... B21D 7/02; B21D 43/00

[52] U.S. Cl. ..... 72/306; 72/422; 72/426

[58] Field of Search ..... 72/306, 294, 323, 321, 72/133, 134, 149, 422, 426

[56] References Cited

U.S. PATENT DOCUMENTS

| | | | |
|---|---|---|---|
| 3,440,859 | 4/1969 | Holtzhauer | 72/399 |
| 3,587,273 | 6/1971 | Smith et al. | 72/133 |
| 3,874,048 | 4/1975 | Millar et al. | 72/422 |
| 4,311,031 | 1/1982 | Schwarze | 72/133 |
| 4,388,039 | 6/1983 | Schwarze | 72/133 |
| 4,662,204 | 5/1987 | Saegusa | 72/306 |

FOREIGN PATENT DOCUMENTS

| | | | |
|---|---|---|---|
| 0192921 | 9/1986 | European Pat. Off. . | |
| 2829444 | 1/1980 | Fed. Rep. of Germany . | |
| 3221986 | 12/1983 | Fed. Rep. of Germany . | |
| 3223881 | 9/1985 | Fed. Rep. of Germany . | |
| 82120 | 5/1984 | Japan | 72/306 |
| 162232 | 7/1986 | Japan | 72/306 |

*Primary Examiner*—Daniel C. Crane

*Attorney, Agent, or Firm*—Young & Thompson

[57] ABSTRACT

An apparatus for bending hollow moldings into spacer frames (44) for insulating glass comprises two bending heads (12) displaceably arranged along the rim of a plate (10), a clamp (13) being provided between these bending heads for the hollow molding to be bent into the spacer frame (44). In this apparatus, a device (20) is provided for feeding hollow moldings which extends in parallel to the rim of the plate (10) at which the bending heads (12) are arranged. Furthermore, a gripper (30) is provided in the plane of symmetry of the clamp (13) for transferring the hollow moldings from the conveying device (20) into the clamp (13) and the bending heads (12).

11 Claims, 7 Drawing Sheets

APPARATUS FOR THE PRODUCTION OF SPACER FRAMES

The invention relates to an apparatus for the production of spacer frames for insulating glass from a hollow molding, with two bending heads displaceably arranged along the rim of a plate, a clamp being provided between these bending heads for the hollow molding to be bent into the spacer frame.

An apparatus for bending hollow moldings into spacer frames for insulating glass has been known from German Pat. No. 3,223,881.

The invention is based on the object of further improving this conventional apparatus and, in particular, improving the feeding of hollow moldings into the bending heads.

In the conventional apparatus for bending hollow moldings into spacer frames for insulating glass, the hollow moldings, previously cut to the length corresponding to the spacer frame of the desired size, are inserted manually. It is, in particular, an object of the present invention to render manual insertion superfluous.

In attaining this object, the apparatus of this invention is distinguished in that a device is provided for feeding hollow moldings, this device extending in parallel to the rim of the plate at which the bending heads are arranged; and in that, in the plane of symmetry of the clamp, a gripper is provided for transferring hollow moldings from the conveying means into the clamp and the bending heads.

By way of the conveying means included in the apparatus, the hollow moldings can be fed without a working step performed by an operator, whereupon they are lifted by the gripper off the conveying means and are inserted in the clamp and the bending heads. After closing of the clamp, whereby the hollow molding is fixed in its longitudinal extension, the bending heads bent the hollow molding into a spacer frame as known from German Pat. No. 3,223,881.

Additional features and details of the invention can be seen rom the dependent claims, directed to advantageous further developments of the apparatus of this invention, and from the following description of a preferred embodiment. In the drawings:

Figure 1:
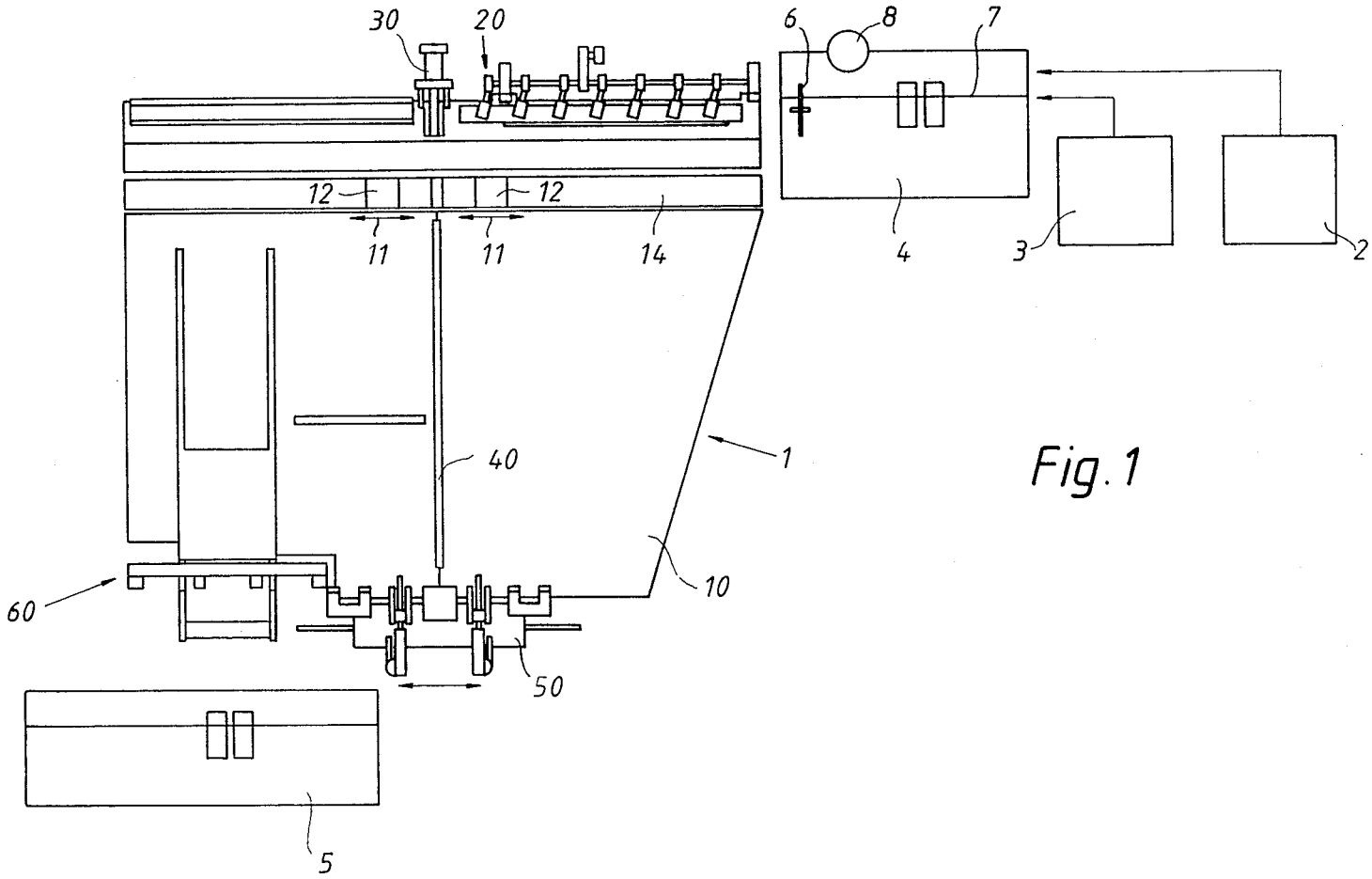
FIG. 1 shows schematically and in a plan view an apparatus for producing a spacer frame for insulating glass, with parts of the plant located upstream and downstream thereof.

A bending apparatus 1, illustrated in FIG. 1, is fed with hollow moldings to be bent into spacer frames, either from a roll-shaping device 2 wherein hollow moldings are formed from sheet-metal strips, or from a magazine 3. In case hollow moldings are fed from a magazine 3, the hollow moldings are welded together into endless hollow moldings in a welding unit 4 which can be of a structure, for example, as disclosed in EP-A1-0 192 921.

The spacer frames produced in the bending apparatus 1 are then transported to a further welding unit 5 wherein the free ends of the hollow molding, bent into a spacer frame, are butt welded together. The welding unit 5 likewise can be designed as known in principle from EP-A1-0 192 921, the welding unit 5 exhibiting a supporting wall inclined somewhat toward the rear, the spacer frames being in contact with this wall during the welding step.

Between the welding unit 4 and the bending apparatus 1, a cutting to length mechanism, designed, for example, as a circular saw, is provided which saws off sections from the hollow molding fed thereto, in correspondence with the length required for the respective spacer frame. For this purpose, a length measuring device, for example an incremental pickup, is arranged beside the conveying route 7 for hollow moldings and controls the saw 6.

The incremental pickup is operated by a friction wheel, a pressure roller that can be urged against the hollow molding being arranged in opposition to this wheel. Between the length measuring device 8 and the saw 6, a drive roll is furthermore provided for conveying the hollow moldings.

The magazine 3 for hollow moldings can be designed as an endless conveyor magazine. Hollow moldings withdrawn from the endless conveyor magazine are fed by means of a vibrating conveyor into the conveying route 7 for hollow moldings.

The bending apparatus 1 comprises a plate 10 inclined by about 10°–30° with respect to the horizontal. In the zone of the upper rim of the plate 10, two bending heads 12 are provided, displaceable in the direction of the double arrows 11. A clamp 13 is arranged in the center between the two bending heads 12, this clamp retaining hollow moldings inserted in the bending heads 12 during the bending process.

Figure 8:
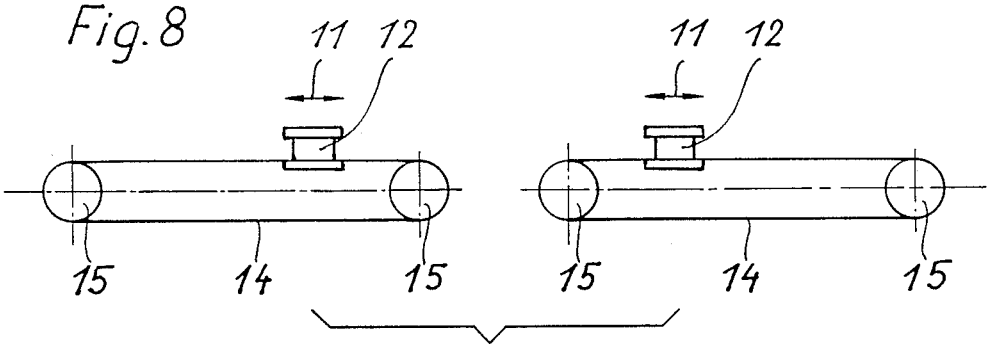
FIG. 8 is a schematic elevational view of the flexible strips that cover the slot in which the bending heads move.

In order to support the hollow molding before and during the bending step, two textile strips 14 are provided, one extending on both sides of each bending head 12 in longitudinal alignment with each other, as flexible cover strips for the slot wherein the bending heads 12 travel along the plate 10. The cover strips 14 are guided over guide rolls 15, two for each strip, arranged, on the one hand, in the region of the clamp 13 and, on the other hand, in the zone of the lateral edges of the plate 10. The arrangement of the strips 14 is diagrammatically shown in FIG. 8.

The bending heads 12 comprise the ejector brackets and deflectors known from German Pat. No. 3,223,881 in order to effect the step of ejecting hollow moldings bent into spacer frames 44 from the bending heads 12.

Figure 2:
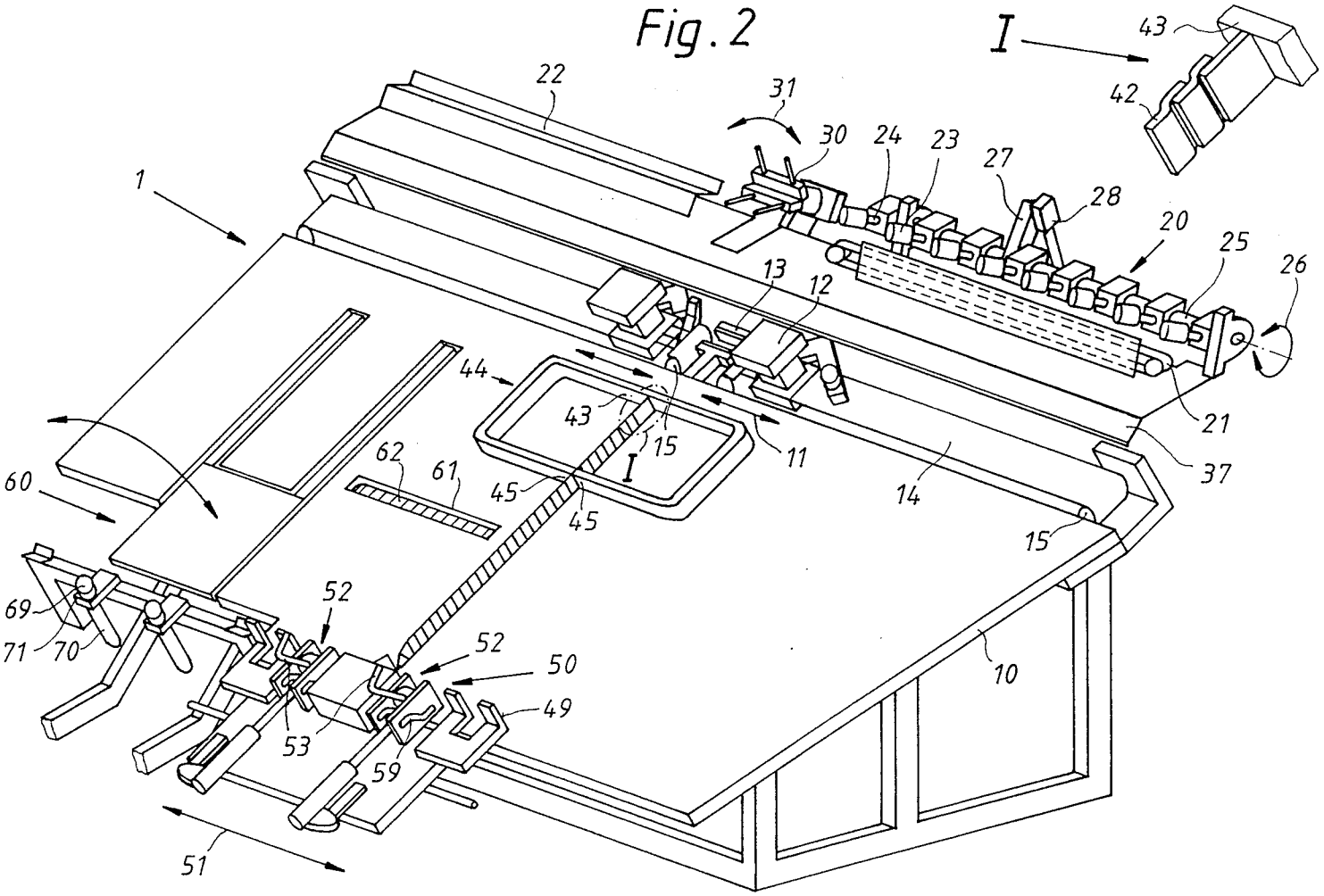
FIG. 2 shows, in an oblique view, a bending apparatus.
Figure 3:
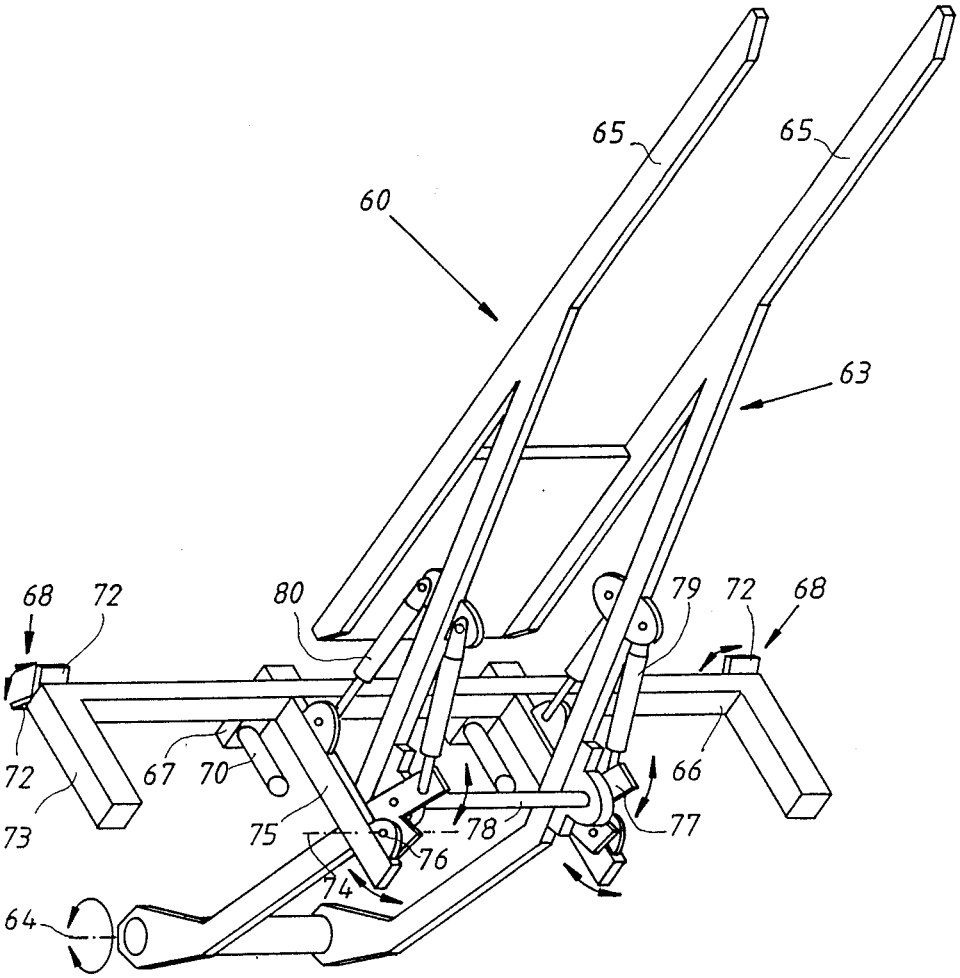
FIG. 3 shows a detail of the apparatus according to FIG. 2.

A conveying means 20 for feeding hollow moldings is provided in parallel to the rim of the plate 10, along which the bending heads 12 can be moved. This conveying means 20 comprises two sections, the section lying on the right in FIG. 2 exhibiting an endless conveying member 21, whereas the section lying on the left in FIG. 2 is designed as a slideway 22.

The endless conveying member 21 is associated with contact rollers 23 that can be brought from above into contact with a hollow molding to be fed. The contact rollers 23 are mounted by way of their axles 24 to a shaft 25 common to all of them, this shaft being rotatable in parallel to the conveying direction (double arrow 26). For this purpose, a guide arm 27 is connected to the shaft 25; this arm can be swung about with the aid of a pressure medium motor 28.

Furthermore, a gripper 30 is provided above the plate 10 which can seize a hollow molding lying on the conveying means 20. By means of a pivoting motion (double arrow 31) of the gripper 30, the hollow molding is transferred from the conveying means 20, while being twisted about its longitudinal axis, into the clamp 13 of the bending apparatus 1. By the twisting about its longitudinal axis, the hollow molding, which rests with one of its broad sides (preferably the side subsequently constituting the outer side of the spacer frame) on the conveying means 20, is turned so that it stands on edge in the clamp 13 the clamp 13 engaging the two broad sides of the hollow molding.

The gripper 30 comprises a supporting arm 32 angled several times and pivotable about an axle 33 located below the conveying means 20 and oriented in parallel to the latter. For this purpose, pressure medium motors, not shown in detail, are provided.

Figure 7:
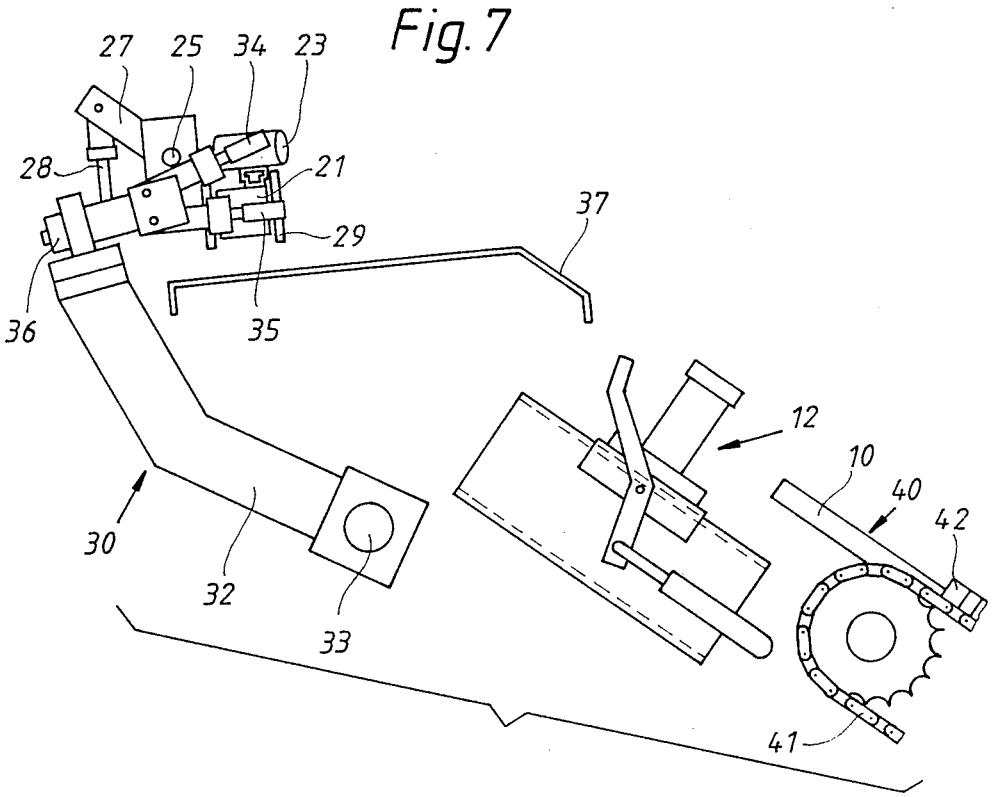
FIG. 7 shows, in a lateral view, a gripper for transferring hollow moldings from the conveying means into the bending heads.

The gripper 30 comprises two clamping jaws 34, 35, each having two tines; these clamping jaws can be brought into contact from below and, respectively, from above with a hollow molding lying on the conveying means 20. In order to move the clamping jaws 34, 35, the later are coupled with a drive motor 36. FIG. 7 shows that the clamping jaws 34, 35 of the gripper 30 are arranged, in the starting position of the latter, in the zone of the conveying route of the conveying means 20. In the position of the gripper 30 associated with the clamp 13, the tines of its clamping jaws 34, 35 are located on both sides of the jaws of the clamp 13.

Furthermore, a guide surface 37 is provided between the conveying route 20 and the path of motion of the bending heads 12; the sections of the hollow molding extending on both sides of the gripper 30 slide along this guide surface, while the hollow molding is transferred from the conveying device 20 into the bending heads 12, onto the cover strips 14.

The conveying route 20 is furthermore associated with a length measuring device, for example an incremental pickup coupled with a guide roller for the endless conveying member 21, and a light barrier (not shown) is further associated with the conveying route, between the end of the conveying member 21 on the delivery side and the gripper 30.

Figure 4:
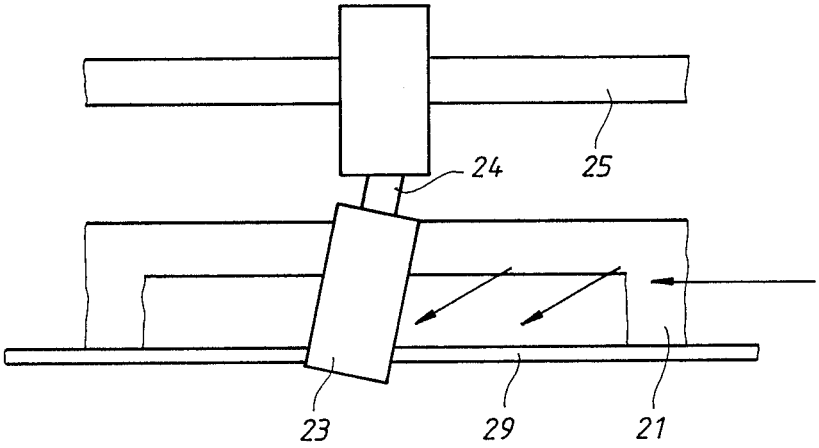
FIG. 4 shows a detail of the conveying means.
Figure 5:
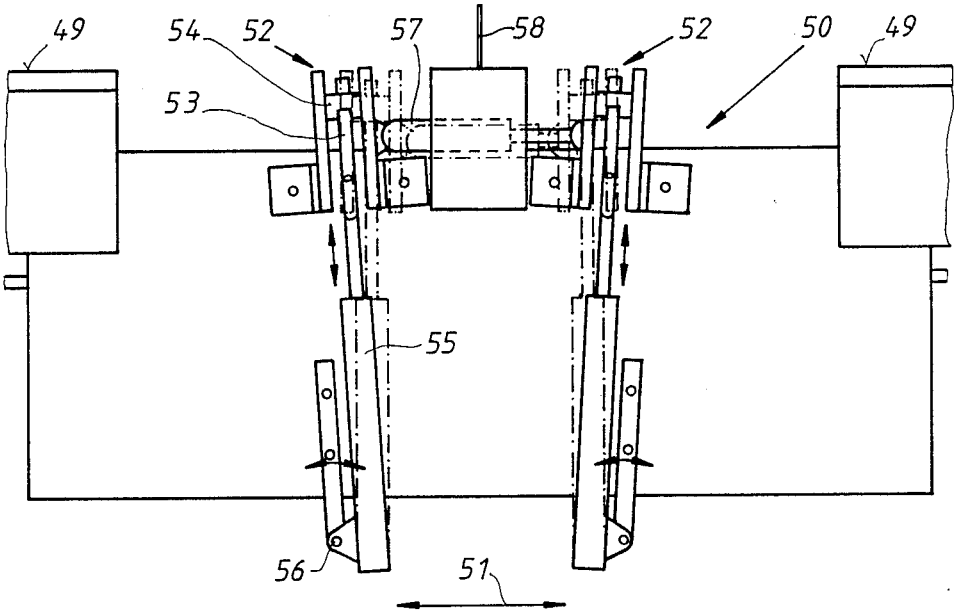
FIG. 5 shows another detail of the apparatus according to FIG. 2.

The pressure rollers 23 can be oriented somewhat obliquely with respect to the conveying direction of the conveying means 20 so that the hollow moldings fed thereon (see FIG. 4) are pulled against a guide strip 29 located on the plate side beside the endless conveying member 21, while these moldings are being fed. Thereby, the hollow moldings are arranged with respect to the clamping jaws 34 and 35 of the gripper 30 so that they are seized by the latter int he zone of their forward ends, and secure insertion in the clamp 13 of the bending apparatus 1 is ensured.

A slot 40, oriented perpendicularly to the travel direction (double arrow 11) of the bending heads 12 is located in the plate 10 of the bending apparatus 1. An endless chain 41 guided about two guide rollers is provided in this slot 40, the upper face of the chain being disposed closely below the topside of the plate 10. Over half of its length, the chain 41 is equipped with upwardly pointing, plate-shaped extensions 42 which, with a corresponding position of the chain 41, project upwardly through the slot 40 in the plate 10. As shown in FIG. 2, the upper horizontal leg of a spacer frame 44, bent in the bending apparatus 1 and ejected from the bending heads 12, is in contact with the uppermost extension 42 of chain 41. The two free ends of the hollow molding, bent into a spacer frame 44, are in contact further down with both sides of extensions 42. By moving the chain 41 in a direction such that extensions 42 move downwardly along plate 10, a spacer frame 44 ejected from the bending heads 12 can be permitted to slide down plate 10 by gravity, at a rate of descent that is controlled by chain 41, to the lower rim of the plate 10 of the bending apparatus 1.

In the zone of the lower rim of plate 10, a conveyor slide 50 is provided which is guided along the lower rim on guide rails so that it is reciprocatable in the direction of double arrow 51 to a transfer means 60 and back again. Drive means (e.g. endless chains or the like), not shown in detail, are provided for moving the conveyor slide 50.

Figure 9:
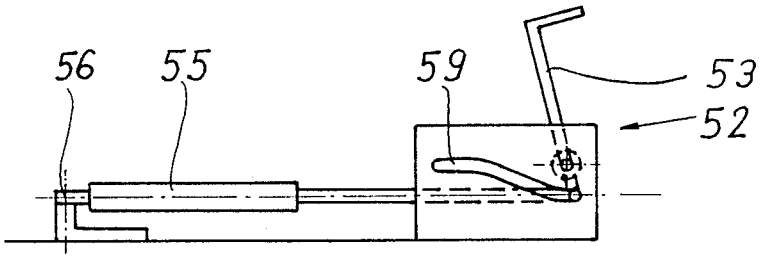
FIGS. 9 and 10 are schematic elevational views of the operating mechanism of the clamping jaws.
Figure 10:
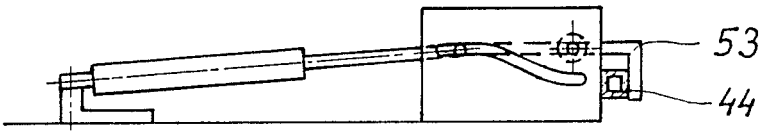

Two clamps 52 are arranged on the conveyor slide 50 which are used to fix in place a spacer frame 44 to the conveyor slide 50 after the spacer frame has been transported from the chain 41 to the lower rim of the plate 10. Each of the clamps 52 comprises a clamping jaw 53 having the shape of a hook which is slidingly guided in swivel bearings 54 on the conveyor slide 50, so that these clamping jaws can be swiveled, on the one hand, under the action of pressure medium cylinders 55 and then can be moved along a contact surface 49 of the conveyor slide 50 for clamping a spacer frame 44. In order to control the movement of the clamping jaws 53 correspondingly, the connecting joints between the piston rods of the pressure medium motors 55 and the clamps 53 are guided in slots 59 arranged in guide plates, as best seen in FIGS. 9 and 10, the slots 59 having approximately the shape of an S. The clamping jaws 52 are furthermore pivotable at the conveyor slide 50 about bearings 56, i.e. about axes perpendicular to the plate 10, under the effect of a pressure medium motor 57; so that the free ends 45 of the spacer frame 44 can be pressed from both sides against a centering shim 58 fixedly mounted at the conveyor slide 50.

Figure 6:
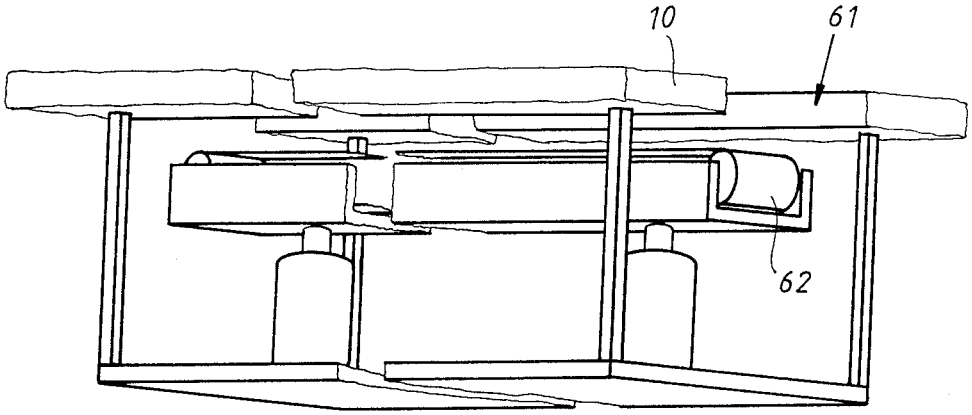
FIG. 6 shows a conveyor belt arranged so that it can be hidden in the plate of the apparatus of FIG. 2.

After a spacer frame 44 has been fixed in place at the conveyor slide 50, the latter travels to the transfer device 60; in this procedure, the movement of the spacer frame 44 along the plate 10 can be enhanced by a conveyor belt 62 provided in a further slot 61 of plate 10. The conveyor belt 62, as shown in FIG. 6, can be lifted from a position hidden underneath the plate 10 (during the bending step) into an operative position wherein it protrudes above the topside of plate 10. The conveyor belt 62 is preferably fashioned as a conveyor strip with outwardly pointing teeth of a rubber-elastic material.

The transfer device 60 is intended for lifting a spacer frame 44 off plate 10 of the bending apparatus 1 and transferring this spacer frame to a welding unit 5 arranged beside the bending apparatus 1 wherein the free ends 45 of the spacer frame 44 are butt welded together.

The transfer device 60 comprises a frame 63 pivotable about an axis 64. On the frame 63, a plate is provided and, emanating therefrom, two crossbars 65 are arranged which are contacted by the upper horizontal leg of a spacer frame 44 during transferring of the spacer frame 44.

Figure 11:
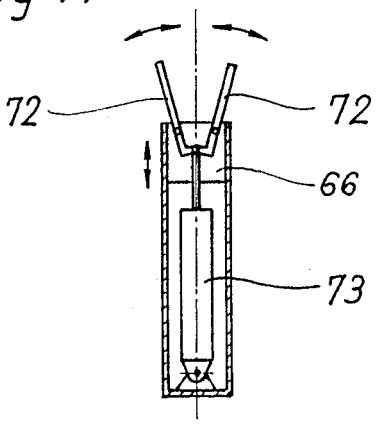
FIG. 11 is a schematic view showing the operation of one of the clamp.

The lower horizontal leg of the spacer frame 44 is retained by means of clamps 67 provided on a beam 66 of the transfer device 60 and is additionally fixed optionally by means of further clamps 68 (if the spacer frame is sufficiently long) provided at the outer ends of the beam 66. The further clamps and their operation are shown in greater detail in FIG. 11.

Figure 12:
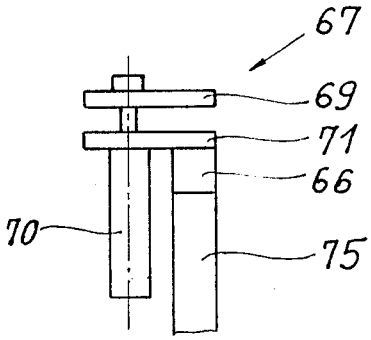
FIG. 12 is a schematic view showing the operation of another of the clamps.

The inner clamps 67 at the beam 66 include respectively one clamping plate 69 displaceable by means of a pressure medium motor 70 toward an abutment 71 rigidly affixed to the beam 66. Clamps 67 and their operation are best seen in FIG. 12.

The two outer clamps 68 comprise clamping jaws 72 pivotable about an axis parallel to the length of the beam 66. For pivoting the clamping jaws 72 of the clamps 68, pressure medium motors 73 are provided.

The beam 66 can be swiveled about an axis 74 oriented in parallel to the longitudinal extension of the beam and in parallel to the lower rim of the plate 10, i.e. it can be reciprocated in the direction of the plate 10. Additionally, the beam 66 can be lifted above the plate 10 and can again be lowered to beneath this plate. For this purpose, the swivel bearings 76 (axis 74) provided at the ends of arms 75 are attached to guide arms 77 attached to a shaft 78. By the operation of pressure medium motors 79, the beam 66 can be lifted and lowered, respectively, with regard to plate 10, whereas by operating the pressure medium motors 80, the beam 66 can be moved to and fro with its clamps 67 and 68 approximately in the plane of plate 10.

The just-described apparatus for producing a spacer frame 44 for insulating glass from a hollow molding operates as follows:

The frame bending apparatus 1 is fed, via the conveying means 20, with a hollow molding which has either been formed by the roll shaping device 2 or has been withdrawn from magazine 3 and endlessly welded together in the welding unit 4. During this step, the hollow molding is cut exactly to length by the saw 6 to the dimension required for producing the respective spacer frame 44. Length measurement is effected by way of the length measuring device 8, fashioned as an incremental pickup and arranged upstream of the saw 6 and downstream of the welding device 4. Furthermore, between the length measuring device 8 and the saw 6, a drive roll (not shown in the drawings) is provided for transporting the hollow molding to the conveyor means 20.

The conveying means 20 at the upper rim of the bending apparatus 1 conveys the correspondingly cut-to-size hollow moldings for such a distance that they are stopped exactly in the center between the bending heads 12. As a result, the butt joint between the free ends 45 of the hollow molding, bent into a spacer frame 44, comes to lie precisely symmetrically with respect to the bending heads 12 and the conveyor slide 50. For this purpose, a light barrier is provided at the end of the endless conveyor 21, detecting the front end of a transported hollow molding and actuating the incremental pickup connected to the endless conveyor 21, for length measurement; this incremental pickup, considering the length of the hollow molding, arrests the drive means for the endless conveyor 21 once the center of the hollow molding lies exactly between the bending heads 12, i.e. is aligned symmetrically with respect to the gripper 30 and/or the clamps 13. After the hollow molding has thus been correctly positioned, the contact rollers 23 are lifted off the endless conveyor 21 by operating the pressure medium motor 28, and the gripper 30 is actuated and insets the hollow molding in the clamp 13 between the bending heads 12. Then the hollow molding is clamped in place in the on-edge position by the clamp 13.

Before performing the bending process, the chain 41 provided in slot 40 of plate 10 is positioned so that the uppermost of the extensions 42 fastened thereto assumes approximately the position indicated in FIG. 2. At this point in time, a spacer frame 44 is produced by bending the hollow molding, for example as described in German Pat. No. 3,223,881. After operating the ejectors at the two bending heads 12, the spacer frame 44 assumes the position shown in FIG. 2, i.e. its upper horizontal leg 43 is in contact with the uppermost extension 42 at the chain 41. The two free ends 45 of the hollow molding, still to be welded together, are in bilateral contact with the upwardly oriented extensions 42 of the chain 41 and/or are disposed beside the extensions 42. Thereupon, the chain 41 is set into motion and the spacer frame 44 is transported along the plate 10 downwardly to the conveyor slide 50. The lower horizontal leg of the spacer frame 44 actuates a capacitive proximity switch, not shown in detail, provided in the plate 10 in the zone of the slide 50, whereupon the two clamps 52 are operated and maintain the spacer frame 44 in contact with the clamping surface 49 of the conveyor slide 50. Thereupon, the two clamps 52 are made to approach each other by activating the pressure medium motor 57 so that the two free ends 45 of the spacer frame 44 are in contact with the centering shim 58. If the stroke of the two clamps 52 is larger than the free spacing of the ends 45 from the centering shim 58, then the clamping jaws 53 slide through along the spacer frame 44.

Then the conveyor slide 50 moves, with the spacer frame 44 held thereby, to the transfer device 60 at the end of plate 10.

In order to avoid warping in case of relatively large-sized spacer frames 44 during the transport thereof, the conveying member 62 is lifted in the slot 61 of plate 10 and supports transportation of the spacer frame 44 to the transfer device 60.

Figure 13:
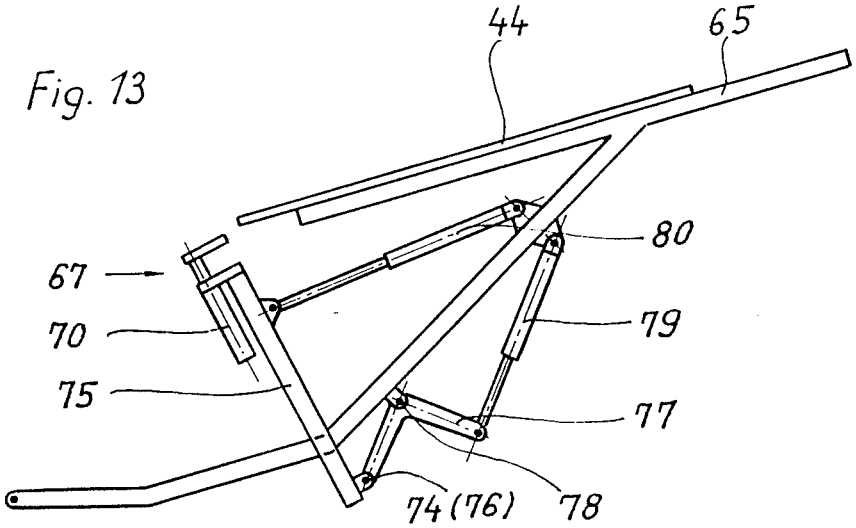
FIGS. 13–15 are schematic views showing the sequence of operation of the clamp of FIG. 12.
Figure 14:
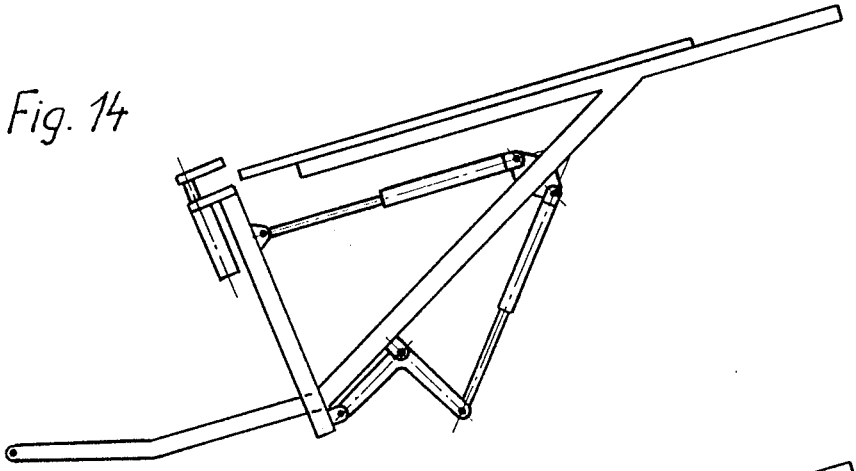
Figure 15:
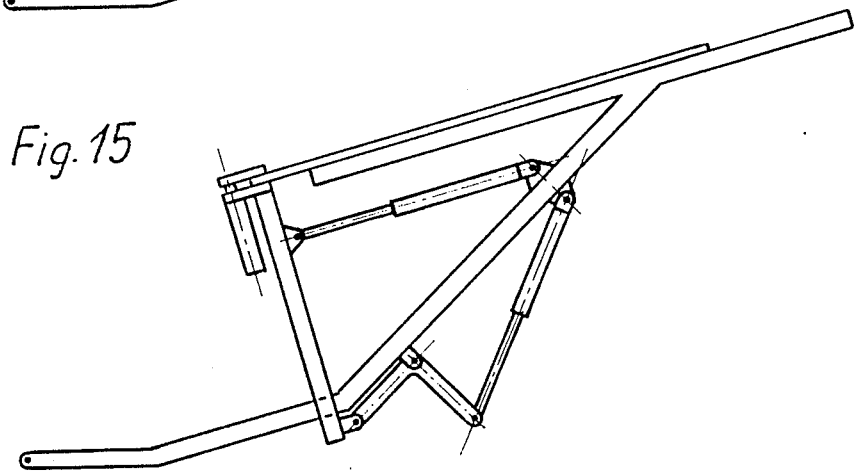

Prior to arrival of the conveyor slide 50, the beam 66 has been shifted downwardly with its clamps 67 and 68 (rotation about shaft 78) so that the clamps 67 and 68 do not impede the feeding of the spacer frame 44. With the clamps 67 and 68 being opened, the beam 66 of the transfer device 60 is now lifted (operation of pressure medium motors 79, see FIG. 13), and moved (operation of pressure medium motors 80, see FIG. 14) to the lower leg of the spacer frame 44 fixedly clamped to the slide 50. Thereupon the clamps 67 and, in case of an adequately long spacer frame, also the clamps 68 are closed (operation of pressure medium motors 70, see FIG. 15) so that the spacer frame 44 is fixed with its lower horizontal leg at the transfer device 60. The clamps 52 of the conveyor slide 50 are opened, the beam 66 of the transfer device 60 moves backwards (operation of pressure medium motors 80), and the slide 50 can be moved back into its starting position illustrated in FIG. 2.

Now the transfer device 60 swings about its axle 64 and places the spacer frame 44 into the welding unit 5 connected downstream of the bending apparatus 1. For inserting the spacer frame 44 in the welding unit 5, the beam 66 with clamps 67 and 68 is moved once again, i.e. with the transfer device 60 being swung upwardly, is moved downwards by the pressure medium motors 80. The clamps 67, 68 open up, and the beam 66 moves upwardly again, whereupon the transfer device 60 is once again swung back into its starting position (FIG. 2).

During this activity of the transfer device 60, the conveyor slide 50 is moved back into its readiness position indicated in FIG. 2 in order to take over the subsequent spacer frame 44 that has been bent in the meantime, and transport same again to the transfer device 60.

After the transfer device 60 has been swung back into its readiness position shown in FIG. 2, the beam 66 is lowered again so that the clamps 67 and 68 are located below the topside of plate 10 of the bending apparatus 1.

In accordance with an embodiment, not shown, the transfer device 60 can be arranged at the lower rim of the plate 10 of the bending apparatus 1 symmetrically to the gripper 30 for transferring the hollow moldings, to be bent into spacer frames 44, from the conveying means 20 into the clamp 13 and the bending heads 12. In this embodiment, no conveyor slide 50 is included, and the device for further processing the spacer frames 44 (e.g. the welding unit 5) is likewise arranged symmetrically to the gripper 30 and to the clamp 13.

In place of the endless chain 41 equipped with extensions 42, it is possible in the apparatus of this invention to provide a carriage as the conveying facility which moves the spacer frames, lifted out of the bending heads 12 and resting on the plate 10, to the lower rim of the plate 10, i.e. to the conveyor slide 50 and or directly to the transfer device 60. This carriage is reciprocatable on guides (e.g. guide rods) oriented perpendicularly to the conveying direction of the conveying means 20 and i parallel to the plane of the plate 10. Furthermore, this carriage is equipped with clamps which seize the spacer frame 44 and release it again as soon as the spacer frame 44 is aligned with respect to the conveyor slide 50 and, respectively, the transfer device 60 and has been seized by the clamping means 52 and, respectively, 67, 68 provided thereat.

What is claimed is:

1. Apparatus for the production of spacer frames for insulating glass from a hollow molding, comprising a plate (10), two bending heads (12) positioned along an edge portion of said plate (10), said bending heads capable of being displaced along an axis both toward and away from one another along said edge portion to position said bending heads relative to said hollow molding at spaced locations, a clamp (13) for the hollow molding between said bending heads, means (20) for the conveying of said hollow moldings along a conveying direction parallel to said axis, said conveying means extending parallel to said edge portion of the plate (10) on which the bending heads (12) are arranged, and a gripper (30) for transferring hollow moldings from the conveying means (20) to the clamp (13) and the bending heads (12), said gripper being rotatable about an axis (33) parallel to both the longitudinal axis of said hollow moldings and the conveying direction so as to move said hollow molding through an arc from said conveying means to said clamp.

2. Apparatus according to claim 1, in which the conveying means (20) has on an inlet side thereof an endless conveying member (21) and on an opposite side of said gripper is positioned a slideway (22) oriented along the same axis as said conveying member (21).

3. Apparatus according to claim 2, and freely rotatable contact rollers (23) above the endless conveying member (21) of the conveying means (20), these contact rollers contacting the hollow moldings from above.

4. Apparatus according to claim 3, and axles (24) carrying the contact rollers (23) mounted on a shaft (25) common to all of them, this shaft being rotatable about an axis parallel to the conveying direction, for lifting the contact rollers (23).

5. Apparatus according to claim 1, in which one clamping jaw (35) of the gripper (30) is arranged, in is starting position associated with the conveying means (20), below the conveying plane, and a second clamping jaw (34) is arranged above the conveying plane.

6. Apparatus according to claim 1, in which clamping jaws (34, 35) of the gripper (30) both have two tines arranged, in the transfer position associated with the clamp (13), on both sides of the clamp (13).

7. Apparatus according to claim 1, and flexible cover strips (14) fastened on both sides to the slides carrying the bending heads (12), these strips covering a slot in the plate (10) wherein the bending heads (12) ca be reciprocated and constituting a support for hollow moldings transferred by the gripper (30).

8. Apparatus according to claim 7, in which each of the flexible cover strips (14) is guided about two guide rollers (15) rotatable about parallel axes that are parallel to the plane of the plate (10).

9. Apparatus according to claim 7, in which the flexible cover strips (14) are textile ribbons.

10. Apparatus according to claim 1, there being a guide surface (37) for the sections of the hollow molding seized by the gripper (30) that extend on both sides of the latter, which guide surface extends between the conveying means (20) and the upper zone of the plate (10).

11. Apparatus according to claim 3, in which axles (24) of the contact rollers (23) extend obliquely with respect to the conveying direction so that a hollow molding carried to this location is guided into contact with a guide strip (29) delimiting the conveying route of the plate side.

* * * * *